US011203869B2

(12) United States Patent
Rapone et al.

(10) Patent No.: US 11,203,869 B2
(45) Date of Patent: Dec. 21, 2021

(54) INSULATION BOARD ASSEMBLY

(71) Applicant: Durabond Products Limited, Toronto (CA)

(72) Inventors: Guido Rapone, Thornhill (CA); Andre Rapone, Maple (CA)

(73) Assignee: Durabond Products Limited, Toronto (CA)

( * ) Notice: Subject to any disclaimer, the term of this patent is extended or adjusted under 35 U.S.C. 154(b) by 0 days.

(21) Appl. No.: 16/865,727

(22) Filed: May 4, 2020

(65) Prior Publication Data

US 2020/0263428 A1 Aug. 20, 2020

Related U.S. Application Data

(63) Continuation of application No. 16/148,509, filed on Oct. 1, 2018, now Pat. No. 10,689,851.

(51) Int. Cl.

| | |
|---|---|
| ***E04C 2/18*** | (2006.01) |
| ***E02D 31/02*** | (2006.01) |
| ***E04B 1/64*** | (2006.01) |
| ***E04C 2/52*** | (2006.01) |
| *E04B 1/76* | (2006.01) |

(52) U.S. Cl.

CPC ..... *E04C 2/18* (2013.01); *E04B 1/64* (2013.01); *E04C 2/52* (2013.01); *E02D 31/02* (2013.01); *E04B 1/762* (2013.01)

(58) Field of Classification Search

CPC ... E04F 13/0869; E04F 13/007; E04F 17/023; E04F 17/04; E04B 1/70; E04B 1/703; E04B 1/7038; E04B 1/7069; E04B 1/7076; E04B 1/7645; E04B 5/48; E04C 1/392; E04C 2/421; E04C 2/523; E02D 31/02

See application file for complete search history.

(56) References Cited

U.S. PATENT DOCUMENTS 4,650,367 A * 3/1987 Dietzler ..... E02B 11/00 405/43
5,410,852 A * 5/1995 Edgar ..... E04B 1/765 52/408

(Continued)

FOREIGN PATENT DOCUMENTS

CA 2136778 A1 ‡ 5/1996
CA 2184205 C ‡ 1/1998

(Continued)

*Primary Examiner* — Kyle J. Walraed-Sullivan
(74) *Attorney, Agent, or Firm* — Bereskin & Parr LLP/S.E.N.C.R.L., s.r.l.

(57) ABSTRACT

An insulation board assembly includes an insulation board body that has a front face, a back face, a top edge, and a bottom edge. The back face has a drainage channel extending from the top edge to the bottom edge. A drainage insert is positioned in the drainage channel proximate the bottom edge of the insulation board body. The drainage insert has a front face, a top edge, a bottom edge, and two side edges, and an insert height measured between the top edge and the bottom edge of the drainage insert. The drainage insert defines at least one interior drainage passage extending from the top edge of the drainage insert to the bottom edge of the drainage insert. A channel height of the drainage channel is preferably at least twice the insert height.

26 Claims, 9 Drawing Sheets

(56) References Cited

U.S. PATENT DOCUMENTS

| | | | | |
|---|---|---|---|---|
| 5,672,391 | A ‡ | 9/1997 | Santarossa | |
| 5,913,788 | A ‡ | 6/1999 | Herren | |
| 5,987,835 | A ‡ | 11/1999 | Santarossa | |
| 6,253,510 | B1 ‡ | 7/2001 | Santarossa | |
| RE37,436 | E ‡ | 11/2001 | Santarossa | |
| 6,352,657 | B1 ‡ | 3/2002 | Veldhuis et al. | |
| D459,007 | S ‡ | 6/2002 | Campacci | |
| 6,698,144 | B1 * | 3/2004 | Larson | E04B 1/765 52/202 |
| D493,897 | S ‡ | 8/2004 | Campacci | |
| 7,018,699 | B2 ‡ | 3/2006 | Dykhoff | |
| D700,717 | S ‡ | 3/2014 | Campacci | |
| 2006/0016142 | A1 * | 1/2006 | Wells | E04B 1/762 52/405.3 |
| 2007/0227086 | A1 ‡ | 10/2007 | Beavers et al. | |
| 2009/0007509 | A1 * | 1/2009 | Jordan | E02D 31/10 52/302.1 |
| 2012/0297697 | A1 ‡ | 11/2012 | Schaefer | |
| 2013/0125487 | A1 ‡ | 5/2013 | Power et al. | |
| 2015/0047281 | A1 * | 2/2015 | Cole | E04F 13/141 52/302.1 |
| 2016/0024788 | A1 * | 1/2016 | Grisolia | A47K 3/405 52/302.1 |
| 2018/0142466 | A1 ‡ | 5/2018 | Power et al. | |
| 2019/0309525 | A1 ‡ | 10/2019 | Santarossa et al. | |

FOREIGN PATENT DOCUMENTS

| | | | |
|---|---|---|---|
| CA | 2230067 | C ‡ | 5/2001 |
| CA | 93969 | S ‡ | 11/2001 |
| CA | 2290770 | C ‡ | 7/2002 |
| CA | 2277751 | C ‡ | 2/2004 |
| CA | 103234 | S ‡ | 6/2004 |
| CA | 103708 | S ‡ | 6/2004 |
| CA | 146178 | S ‡ | 11/2013 |
| CA | 3014820 | A1 ‡ | 10/2019 |
| EP | 1315870 | B1 ‡ | 12/2007 |

* cited by examiner
‡ imported from a related application

INSULATION BOARD ASSEMBLY

CROSS-REFERENCE TO RELATED APPLICATION

This application is a continuation of U.S. application Ser. No. 16/148,509, filed Oct. 1, 2018, which is incorporated by reference herein in its entirety.

FIELD

This disclosure relates generally to insulation systems and methods, and more specifically to insulation board assemblies that facilitate drainage between the assembly and a wall surface to which it may be secured.

INTRODUCTION

Thermal insulation may be used to inhibit or prevent heat transfer into, out of, and/or within residential, commercial, and/or industrial buildings. For example, most residential buildings have thermal insulation positioned throughout most if not all of the building envelope.

Typical insulation materials used in building construction include glass fiber, glass wool, polystyrene, urethane foam, and the like. Often, the insulation may be installed in pre-formed segments (e.g. glass wool batting or polystyrene boards). Once an insulation system has been installed and covered by interior and/or exterior wall finishes, accessing the insulation system for maintenance or repair may be time consuming and/or expensive.

SUMMARY

The following introduction is provided to introduce the reader to the more detailed discussion to follow. The introduction is not intended to limit or define any claimed or as yet unclaimed invention. One or more inventions may reside in any combination or sub-combination of the elements or process steps disclosed in any part of this document including its claims and figures.

In accordance with a broad aspect, there is provided insulation board assembly comprising: an insulation board body having a front face, a back face, a top edge, a bottom edge, and two side edges, the back face having a drainage channel extending from the top edge to the bottom edge, the drainage channel being recessed inward of the back face by a channel depth; and a drainage insert positioned in the drainage channel proximate the bottom edge of the insulation board body, the drainage insert having a front face, a top edge, a bottom edge, two side edges, the drainage insert defining at least one interior drainage passage extending from the top edge of the drainage insert to the bottom edge of the drainage insert.

In some embodiments, the insulation board body consists substantially of mineral fibre insulation.

In some embodiments, the drainage insert has a rear face, and the at least one interior drainage passage is defined by at least a portion of the front and rear faces of the drainage insert, and by at least one of the side edges of the drainage insert.

In some embodiments, the drainage insert has at least one interior wall member positioned between the two side edges of the drainage insert and extending between the front face and the rear face of the drainage insert.

In some embodiments, the bottom edge of the drainage insert is flush with the bottom edge of the insulation board body.

In some embodiments, the drainage insert is positioned in the drainage channel such that a front face of the drainage insert is flush with the back face of the insulation board body.

In some embodiments, the drainage insert has a thickness between the front face and a rear face of the drainage insert that is approximately equal to the channel depth.

In some embodiments, the drainage insert has a width between the two side edges of the drainage insert that is approximately equal to a width of the drainage channel.

In some embodiments, the insulation board body has at least one additional drainage channel extending from the top edge to the bottom edge of the insulation board body.

In some embodiments, a thickness between the front and back faces of the insulation board body is between about 1.5" (38 mm) and about 6" (152 mm).

In some embodiments, the thickness between the front and back faces of the insulation board body is between about 2" (50 mm) and 5" (127 mm).

In some embodiments, the thickness between the front and back faces of the insulation board body is about 3" (76 mm).

In some embodiments, the channel depth is about ⅜" (10 mm).

In some embodiments, a width of the drainage channel is between about 1" (26 mm) and 4" (102 mm).

In some embodiments, the width of the drainage channel is about 2" (51 mm).

In some embodiments, the insulation board body has a density of about 4 to 12 lbs/ft3 (64 to 192 kg/m3).

In some embodiments, the insulation board body has a density of about 6 to 10 lbs/ft3 (96 to 160 kg/m3).

In some embodiments, the insulation board body has a density of about 8 lbs/ft3 (128 kg/m3).

In some embodiments, the insulation board body has an R-value at 1" and at 75° f of about 4.0 hr·ft2/Btu, or an RSI value at 25.4 mm and at 24° C. of about 0.70 m2K/W.

In some embodiments, a juncture of the back face and the top edge of the insulation board body is beveled.

In some embodiments, the insulation board assembly may further comprise a reinforcing mesh secured to the insulation board body, the reinforcing mesh extending from the back face of the body, across the bottom edge, to the front face of the body, such that the reinforcing mesh positioned on the back face of the body overlaps at least a portion of the drainage insert.

In some embodiments, the reinforcing mesh positioned on the back face of the body overlaps the entire drainage insert.

In some embodiments, the insulation board assembly may further comprise a base coat applied to the reinforcing mesh at locations other than a lower end of the drainage channel.

In some embodiments, the base coat is a cementitious base coat.

It will be appreciated by a person skilled in the art that a method or apparatus disclosed herein may embody any one or more of the features contained herein and that the features may be used in any particular combination or sub-combination.

These and other aspects and features of various embodiments will be described in greater detail below.

BRIEF DESCRIPTION OF THE DRAWINGS

For a better understanding of the described embodiments and to show more clearly how they may be carried into effect, reference will now be made, by way of example, to the accompanying drawings in which.

Figure 1:
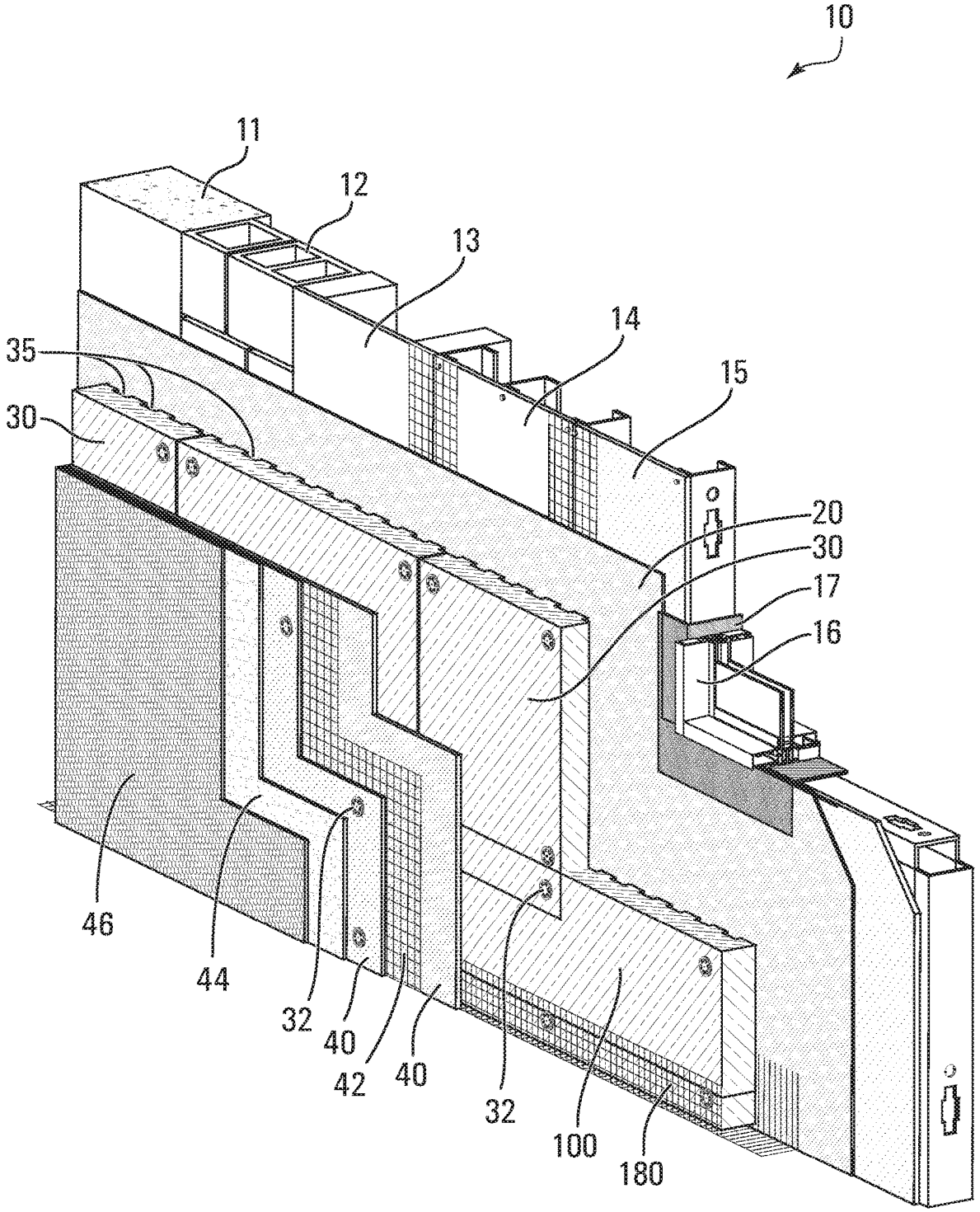
FIG. 1 is a schematic perspective view of an insulation system that includes an insulation board assembly.
Figure 2:
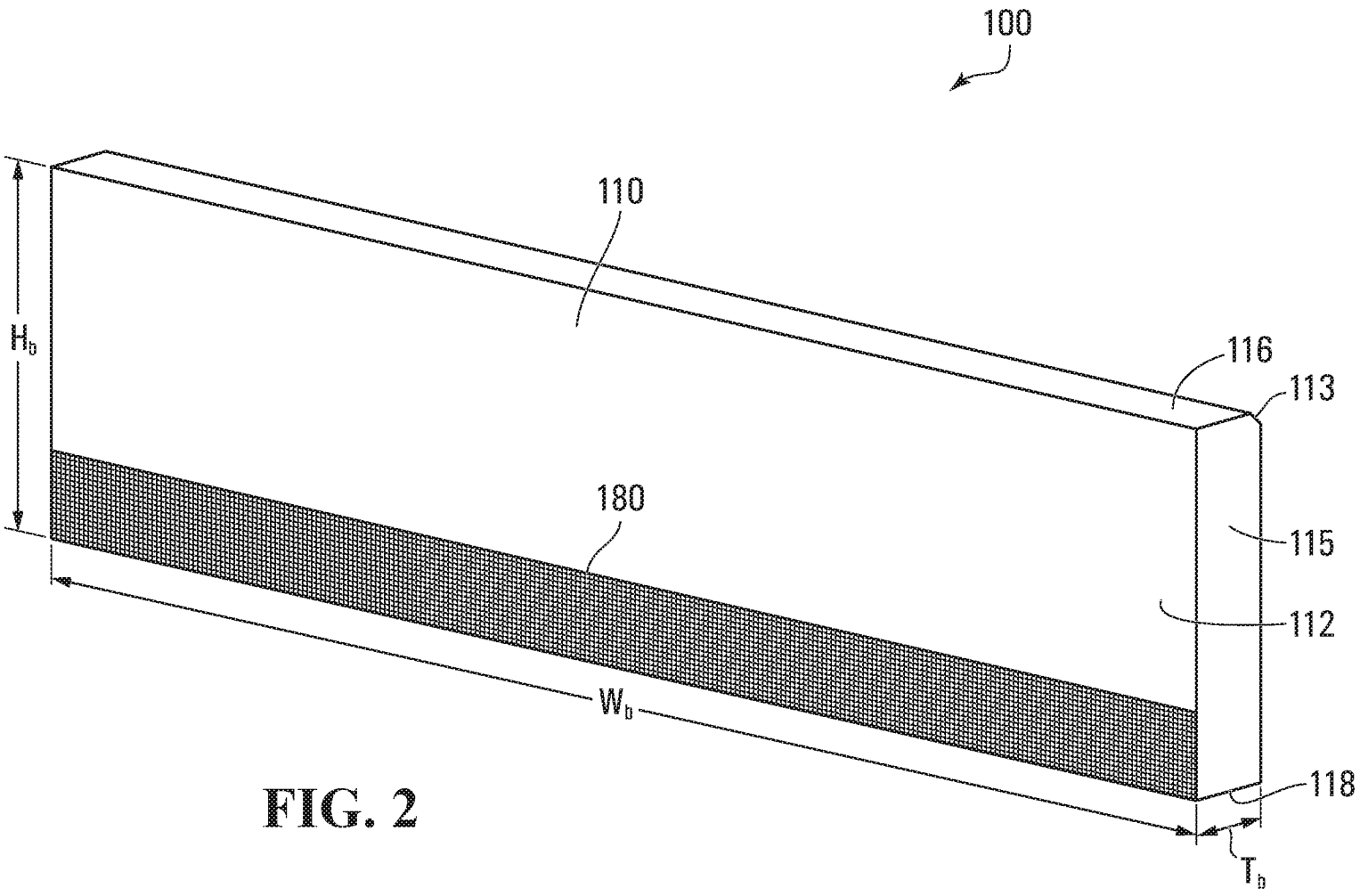
FIG. 2 is a perspective view of the front side of an insulation board assembly in accordance with one embodiment.
Figure 3:
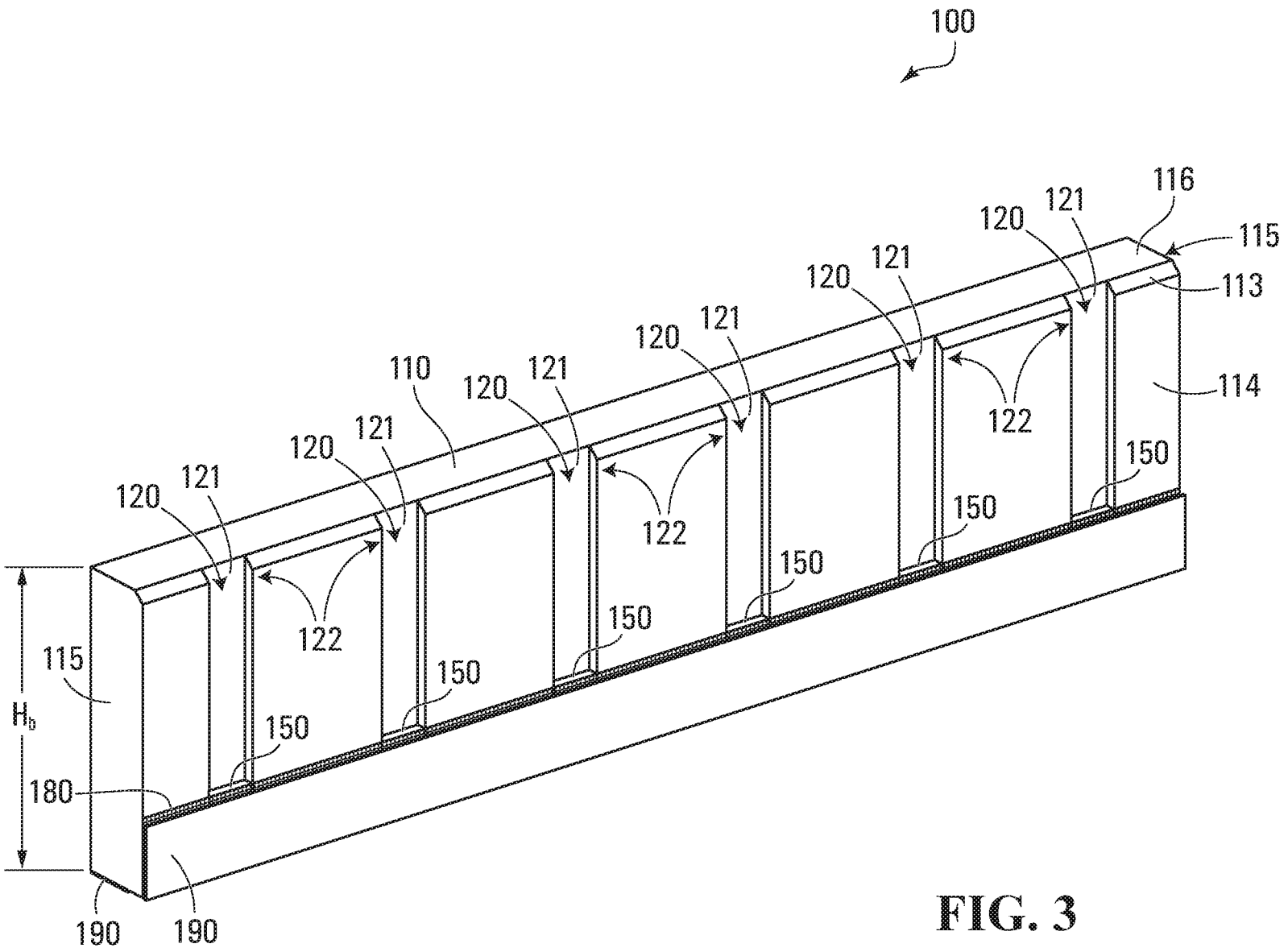
FIG. 3 is a perspective view of the back side of an insulation board assembly of FIG. 2.

The drawings included herewith are for illustrating various examples of articles, methods, and apparatuses of the teaching of the present specification and are not intended to limit the scope of what is taught in any way.

DESCRIPTION OF EXAMPLE EMBODIMENTS

Various apparatuses, methods and compositions are described below to provide an example of an embodiment of each claimed invention. No embodiment described below limits any claimed invention and any claimed invention may cover apparatuses and methods that differ from those described below. The claimed inventions are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

FIG. 1 illustrates a schematic example of an example exterior insulation system, referred to generally as 10. As shown in the illustrated example, a water penetration barrier 20 is provided against a wall substrate such as concrete 11, masonry 12, plywood or oriented strand board (OSB) 13, glass mat coated gypsum board 14, cement board 15, or the like. Optionally, a window frame 16 and a transition membrane 17 may be provided.

Insulation may be positioned against the water penetration barrier 20. In the illustrated example, one or more rectangular sheets of insulation 30 are secured against the water penetration barrier 20 to form a substantially uninterrupted thermal barrier. The insulation sheets 30 are illustrated as being secured using mechanical fasteners 32, although it will be appreciated that any suitable securement method may be used.

Preferably, the face of the insulation sheets 30 that abuts the water penetration barrier 20 (which may be characterized as the back face) has one or more recessed drainage channels 35, to provide a path for water and/or other liquids that may accumulate (e.g. via condensation, leakage, etc.) between the water penetration barrier 20 and the insulation sheets 30 to travel downwardly under the influence of gravity to one or more drains or other collection areas.

Also illustrated is an insulation board assembly, referred to generally as 100, provided at the lower edge of the insulation, and in this example at the lower edge of the wall.

Exterior insulation system 10 may also include a base coat 40 with an embedded mesh 42, an optional primer 44, and/or an architectural finish coat 46.

FIGS. 2 to 8 illustrate an example of an insulation board assembly 100. The insulation board assembly 100 includes a main body 110, which has a front face 112, and an opposing back face 114. Main body 110 also has a top edge 116, a bottom edge 118, and two side edges 115. In the illustrated embodiment, main body 110 has generally rectangular faces, and may be characterized, generally, as a rectangular cuboid.

Main body 110 is preferably made from mineral fibre (which may also be referred to as mineral wool, mineral wool fiber, steel wool, or mineral cotton). An advantage of providing a main body made substantially or completely of mineral fibre insulation is that it is considered a noncombustible product with fire resistance properties. For example, mineral wool fiber insulation boards made from basalt rock and slag, may have a melting point of about 2150° F. (1177° C.). Preferably, the mineral wool body is in conformance with one or more of the following standards: ASTM E 136 Behaviour of Materials at 750° C. (1382° F.) Non-Combustible; CAN/ULC-S114 Test for Non-Combustibility Non-Combustible; ASTM E 84 (UL 723) Surface Burning Characteristics Flame Spread=0, Smoke Developed=0; and/or CAN/ULC-5102 Surface Burning Characteristics Flame Spread=0, Smoke Developed=0.

An advantage of insulation board assembly 100 having a main body made of mineral wool is that the assembly 100 may constitute and/or form part of a firestop. For example, use of assembly 100 may reduce or eliminate the need for additional fire stopping that may otherwise be recommended and/or mandated (e.g. via national, provincial/state, and/or local building codes). Additionally, or alternatively, it may facilitate providing continuous exterior insulation in situations where non-combustible construction or non-combustible cladding is required.

In addition to its fire resistance, a mineral wool body may have desirable thermal insulation properties. For example, it may have a density of about 4 to 12 lbs/ft3 (64 to 192 kg/m3), from about 6 to 10 lbs/ft3 (96 to 160 kg/m3), or 8 lbs/ft$^3$ (128 kg/m$^3$). Additionally, or alternatively, it may have an R-value at 1" and at 75° f of about 4.0 hr·ft$^2$/Btu, or an RSI value at 25.4 mm and at 24° C. of about 0.70 m$^2$K/W.

Main body 110 may have any suitable dimensions. For example, main body 110 may have a width $W_b$ of about 48", a height $H_b$ of about 12", and a thickness $T_b$ of between about 1.5" (38 mm) to 6" (152 mm), of between about 2" (50 mm) and 5" (127 mm), or about 3" (76 mm).

In the illustrated embodiment, main body 110 also has a beveled edge 113 at the juncture of the back face 114 and the top edge 116. Providing a bevel at this location may have one or more advantages. For example, it may allow for a consistent drainage path of any incidental moisture which may accumulate at the back of the system to drain out from one or more of the drainage channels in the event that the channels are or become misaligned and/or obstructed. Alternatively, such a bevel may not be provided.

Figure 6:
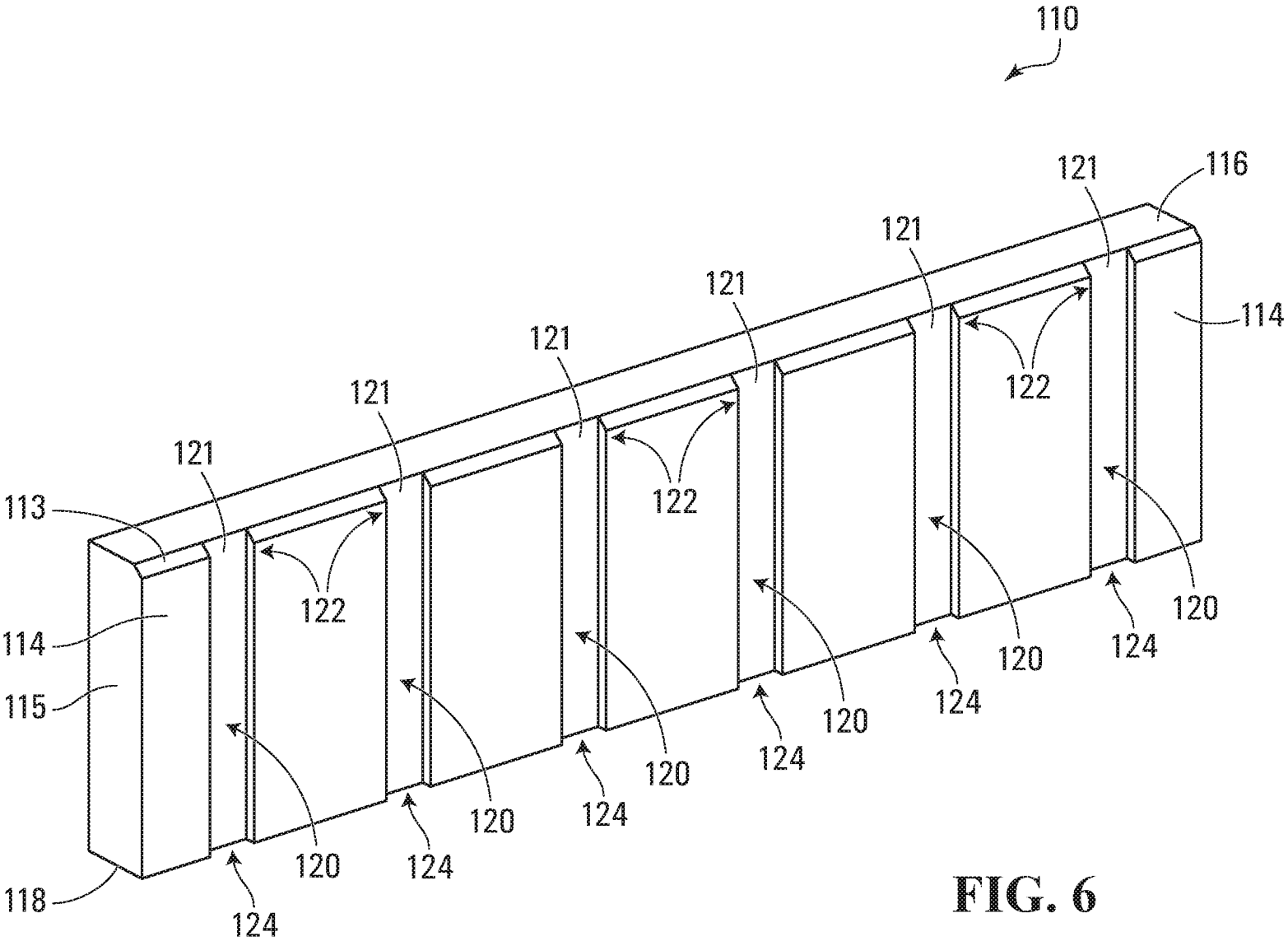
FIG. 6 is a perspective view of the back side of the insulation board body of the insulation board assembly of FIG. 2.

As perhaps best illustrated in FIG. 6, the back face 114 of main body 110 has a plurality of drainage channels 120. Each channel 120 extends from an upper end 122 at the top edge 116 of main body 110 to a lower end 124 at the bottom edge 118 of main body 110. Channel 120 has a channel width $W_c$. For example, each channel 120 may have a channel width We of between about 1" and 4", and may be about 2". It will be appreciated that the channels may have any suitable width in one or more alternative embodiments.

The drainage channels 120 are recessed inward of the back face 114 by a channel depth $D_c$. For example, each channel 120 may have a channel depth $D_c$ of about 7/16" (11 mm). It will be appreciated that the channels may have any suitable depth in one or more alternative embodiments.

Any suitable number of channels 120 may be provided. For example, channels 120 may be provided at approximately equal intervals $I_c$ across the back face 114. For example, channels 120 may be provided approximately 6" from each other, or at any other suitable spacing. Alternatively, channels may be provided at irregular intervals. Preferably, the number, width, and/or location of the upper ends 122 of the channels 120 may be selected to match the number, width, and/or location of the bottom ends of channels provided in an insulation board to be installed in an abutting relationship with the top edge of main body 110.

In the illustrated example, the channels are linear, and are generally perpendicular to the top and bottom edges 116 and 118, and generally parallel to the side edges 115. Alternatively, the channels may be curved, serpentine, diagonal, or have any other suitable shape and/or pattern.

Insulation board assembly 100 also includes one or more drainage inserts 150. In the illustrated example, drainage insert 150 has a front face 152, a rear face 154, a top edge 156, a bottom edge 158, and two side edges 155. In the illustrated embodiment, drainage insert 150 has generally rectangular faces, and may be characterized, generally, as a rectangular cuboid.

Drainage inserts 150 are positioned in the drainage channels 120 proximate the lower end 124 of the channel 120, and thus proximate the bottom edge 118 of the main body 110. For example, drainage insert 150 may be positioned such that the bottom edge 158 of insert 150 is substantially flush with the bottom edge 118 of the main body 110.

Each drainage insert 150 may have any suitable dimensions. For example, drainage insert 150 may have a width $W_d$ of about 2" (51 mm), a height $H_d$ of about 3" (76 mm), and a thickness $T_d$ of about 7/16" (11 mm).

Preferably, the width $W_d$ of drainage insert 150 corresponds to the width $W_c$ of the drainage channel 120 in which it is positioned, such that when the drainage insert 150 is positioned in the channel 120 it extends across substantially all of the channel width $W_c$.

Figure 7:
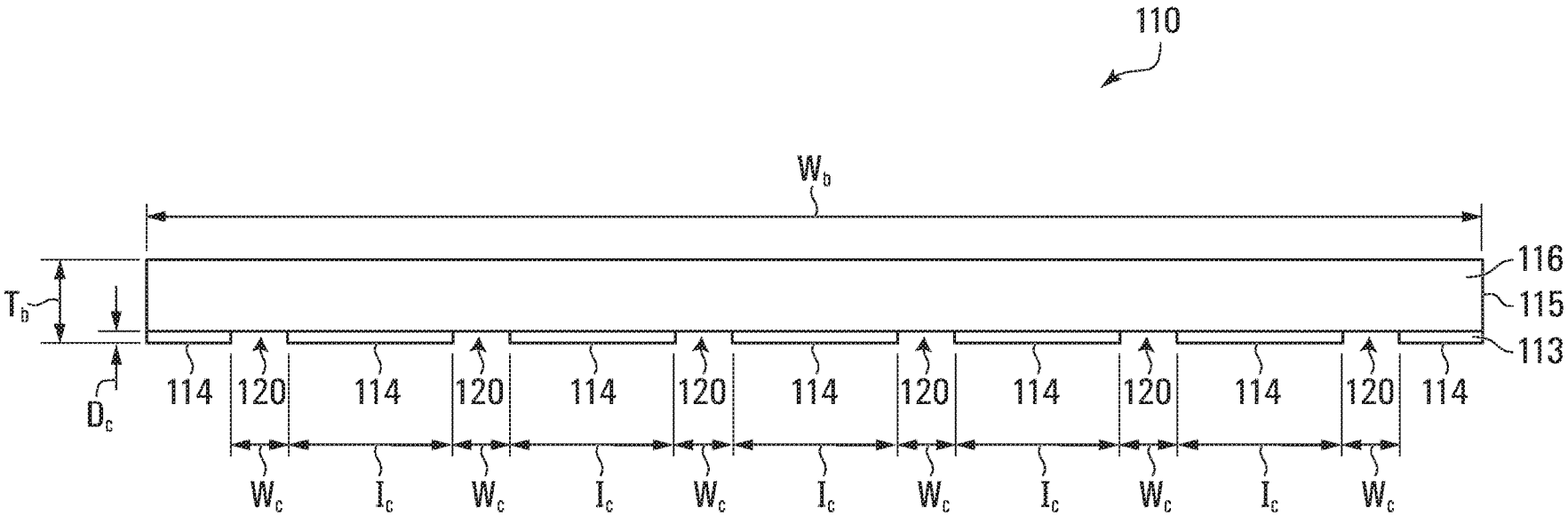
FIG. 7 is a top view of the insulation board body of FIG. 6.
Figure 8:
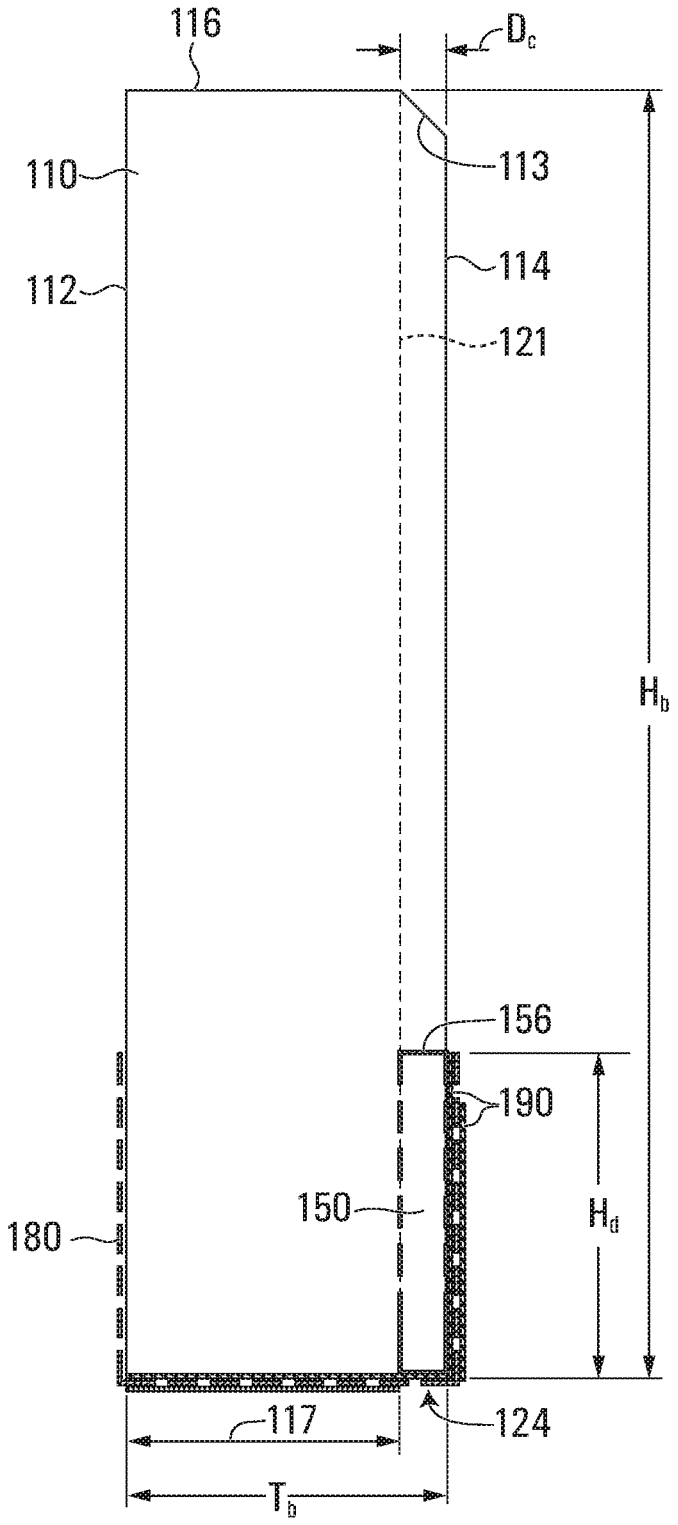
FIG. 8 is a side view of insulation board assembly of FIG. 2.
Figure 9:
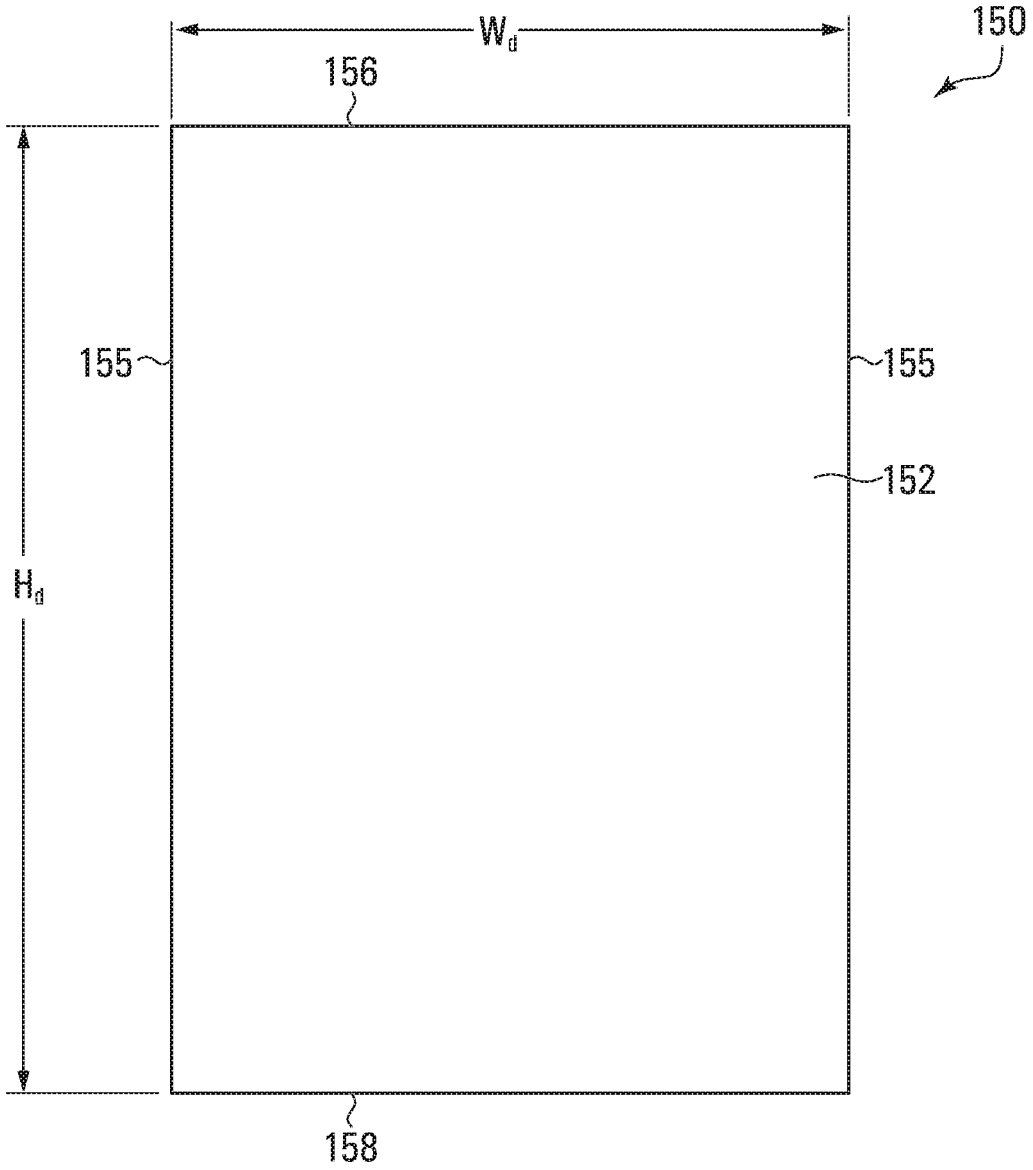
FIG. 9 is a front view of a drainage insert, in accordance with one embodiment.

Preferably, the thickness $T_d$ of drainage insert 150 corresponds to the depth $D_c$ of the drainage channel 120 in which it is positioned, such that when the drainage insert 150 is positioned in the channel 120 with the rear face 154 abutting an inner face 121 of the channel 120, the front face 152 of the insert 150 is substantially flush with the back face 114 of main body 110 (see e.g. FIGS. 7 and 8). Alternatively, one or more spacers (not shown) may be provided between the inner face 121 of the channel 120 and the drainage insert 150, such that the front face 152 of the insert 150 is substantially flush with the back face 114 of main body 110.

An advantage of having the front face 152 of each drainage insert 150 substantially flush with the back face 114 of main body 110 is that the insulation board assembly 100 has a generally rectangular perimeter at the lower edge of the main body 110. This generally rectangular perimeter may facilitate the installation of insulation board assembly 100, and/or may facilitate the provision of an optional reinforcing mesh (discussed further below).

Figure 10:
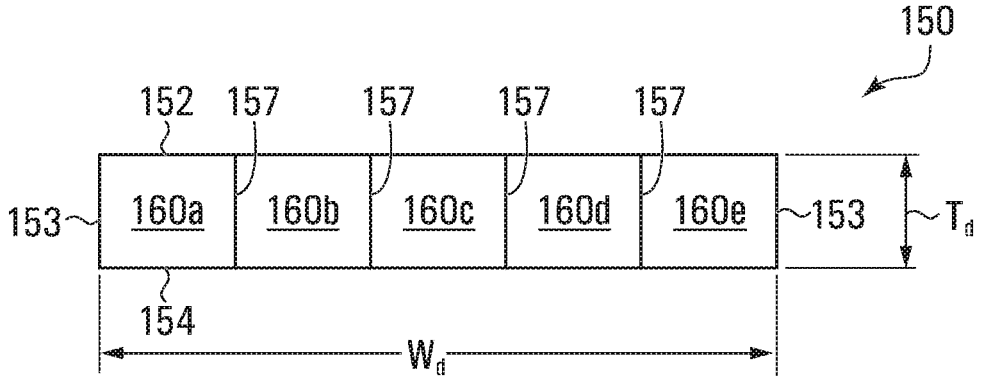
FIG. 10 is a top view of the drainage insert of FIG. 9.

As illustrated in FIG. 10, drainage insert 150 may have one or more interior drainage passages 160 extending through the drainage insert 150 from the top edge 156 to the bottom edge 158. Accordingly, when drainage insert 150 is positioned in channel 120, drainage passages 160 provide a path for water and/or other liquids traveling downwardly through the channels 120 to pass through the drainage insert 150.

In the illustrated example, four interior wall members 157 are provided in addition to side wall members 153, resulting in five drainage passages 160*a-e* through drainage insert 150. Alternatively, more or fewer interior wall members may be provided, defining any suitable number of drainage passages 160.

In the illustrated example, the perimeter of each drainage passage 160 is defined entirely by the drainage insert 150. Alternatively, or additionally, one or more drainage passages 160 may be cooperatively defined by the drainage insert 150 and the faces of drainage channel 120 (e.g. between inner face 121 and drainage insert 150).

Optionally, insulation board assembly 100 may also include a reinforcing mesh secured to the mineral wool body. For example, the reinforcing mesh may assist in maintaining drainage inserts 150 in their position within drainage channels 120. Alternatively, or additionally, the reinforcing mesh may provide structural rigidity to at least the lower end of main body 110.

Any suitable reinforcing mesh may be used. For example, an open weave, glass fiber fabric, alkali resistant fabric, weighing 203 g/m$^2$ (6.0 oz/yd$^2$) may be used, such as Durex 045 Standard Plus Reinforcing Mesh as available from Durabond Products Limited.

Figure 4:
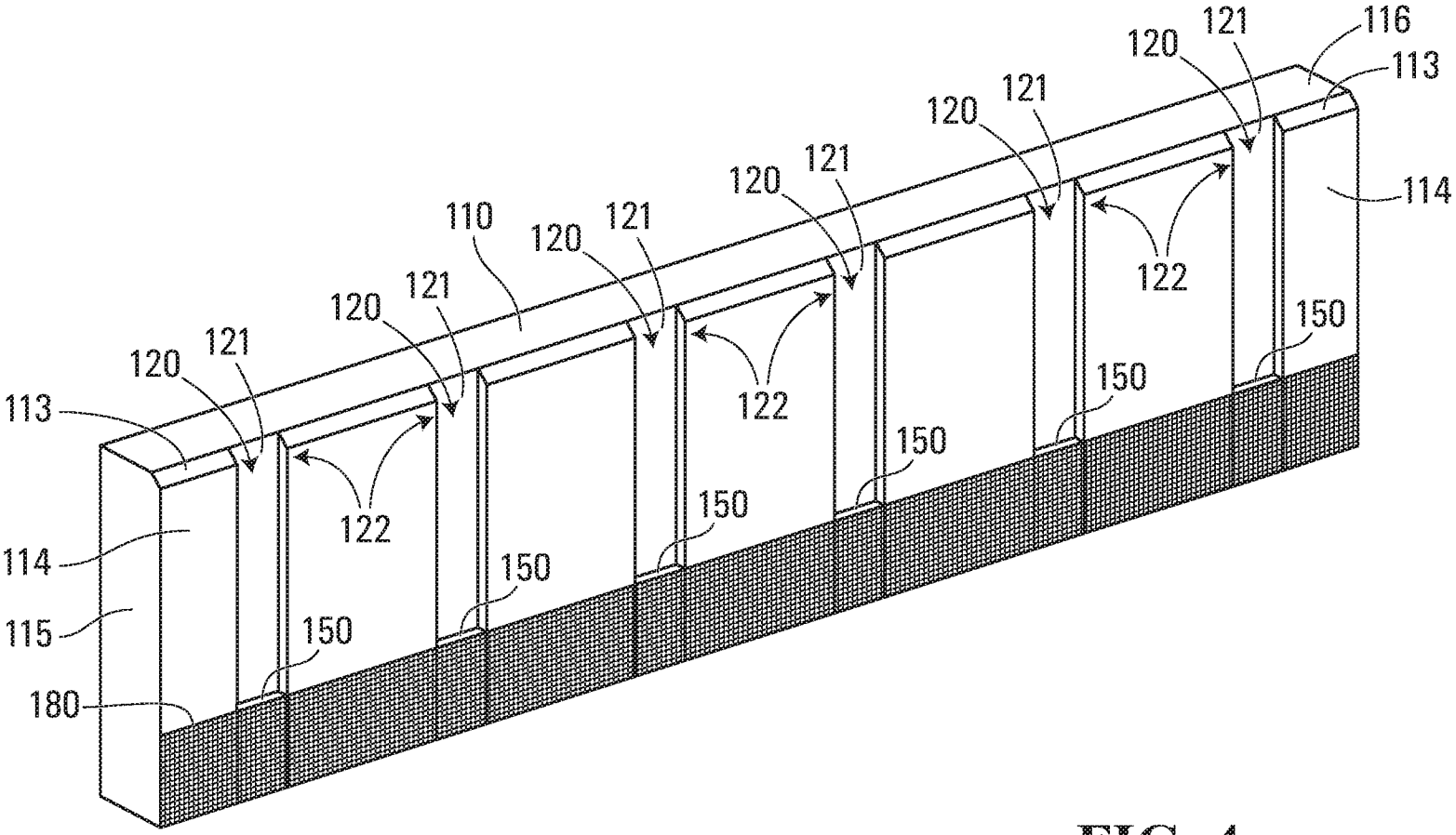
FIG. 4 is a perspective view of the back side of the insulation board assembly of FIG. 2, without a base coat.
Figure 5:
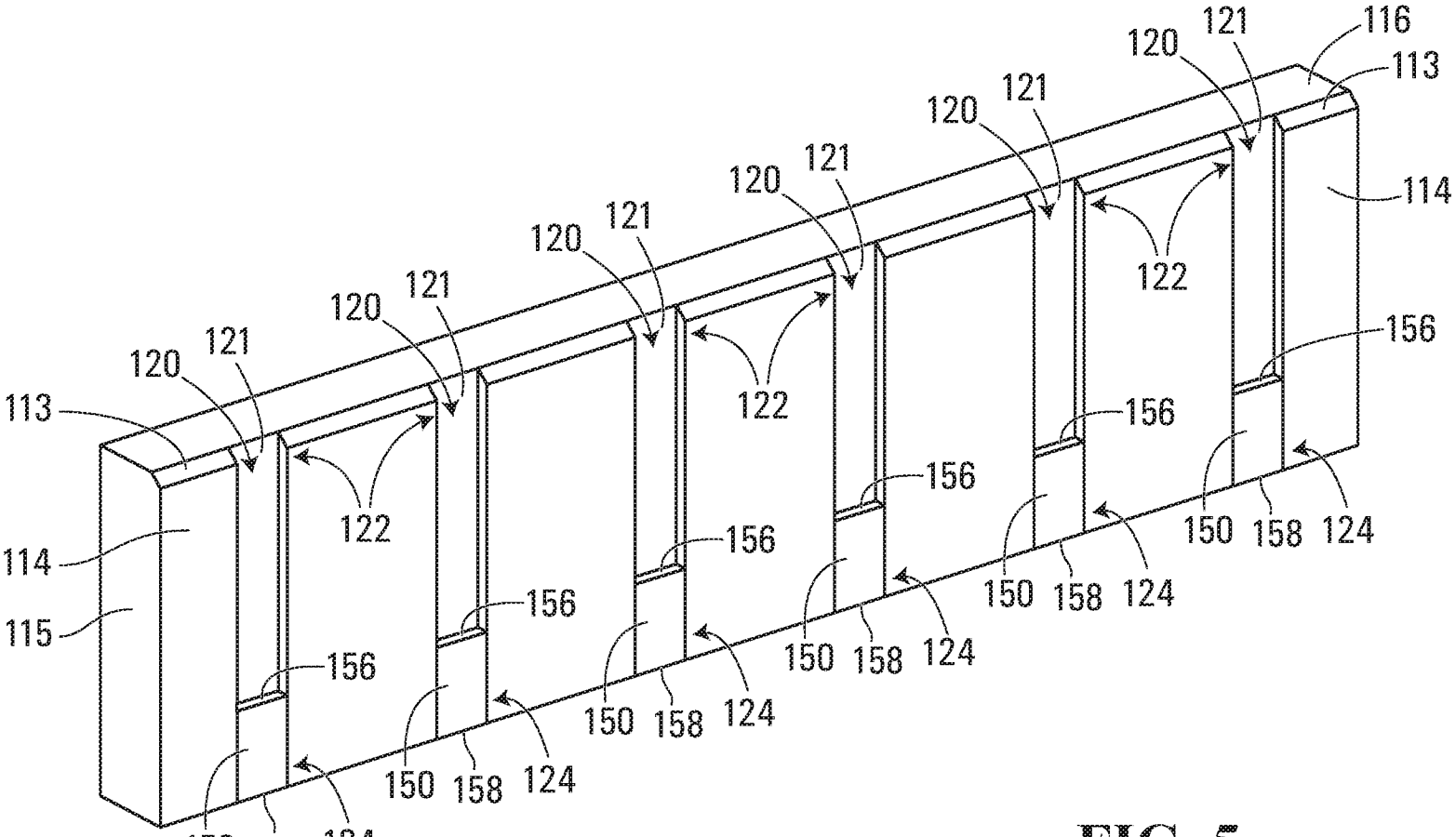
FIG. 5 is a perspective view of the back side of the insulation board assembly of FIG. 4, without a base coat and without a reinforcing mesh.

In the illustrated example, reinforcing mesh 180 extends from the front face 112 of the body 110, across the bottom edge 118, to the back face 114. As shown in FIGS. 4 and 8, reinforcing mesh 180 extends along the back face 114 of the body 110 such that it overlaps the entire drainage insert 150. Alternatively, reinforcing mesh 180 may only overlap a portion of drainage insert 150.

Optionally, one or more base coats (which may also be referred to as scratch coats) of e.g. a cementitious material may be applied to at least a portion of the reinforcing mesh. For example, a two-component trowel applied base coat meeting ULC/CAN-5114 Test for Determination of Non-Combustibility in Building Materials may be used, such as Durex Uniplast as available from Durabond Products Limited (a polymer modified cementitious base coat mixed with Acrybond S, a water based 100% acrylic polymer additive formulated to provide a highly flexible and crack resistance). Alternatively, any other suitable cementitious or non-cementitious base coat material may be applied.

The one or more base coats 190 are preferably applied at locations other than a lower end of the drainage channels 120, such that the drainage channels are not occluded by the base coat. In the illustrated example, base coat 190 is applied to the mesh 180 along the back face 114 of main body 110, and along a rear portion 117 of the bottom edge 118. For example, base coat 190 may not be applied over the forward ½" (12.7 mm) of the bottom edge 118 of main body 110.

Providing an insulation board assembly that includes a body with pre-formed drainage channels and is pre-back wrapped with a factory-applied base coat and reinforcing mesh may have one or more advantages. For example, providing such a pre-formed and pre-assembled component to a worksite may promote improved quality of construction of the piece, e.g. it may promote or ensure that the proper base coating thickness is applied, and/or that the base coat is continuous across the entire board assembly, and/or that the bottoms of the drainage channels and/or drainage inserts are not obscured (e.g. by inadvertently applying base coat across the openings). Additionally, or alternatively, it may be easier for site installers to be provided with a pre-assembled component. Additionally, or alternatively, it may save time and/or decrease costs during construction of a wall system, as the insulation board assembly may be installed as a modular component.

As used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. An insulation board assembly comprising:

an insulation board body that consists of mineral fibre insulation, the insulation board body having a front face, a back face, a top edge, a bottom edge, and two side edges, the back face having a drainage channel extending from the top edge to the bottom edge, the drainage channel having a channel height measured between the top edge and the bottom edge of the insulation board body, the drainage channel being recessed inward of the back face by a channel depth; and a drainage insert positioned in the drainage channel proximate the bottom edge of the insulation board body, the drainage insert having a front face, a top edge, a bottom edge, two side edges, and an insert height measured between the top edge and the bottom edge of the drainage insert, the drainage insert defining at least one interior drainage passage extending from the top edge of the drainage insert to the bottom edge of the drainage insert, wherein the channel height is at least twice the insert height.

2. The insulation board assembly of claim 1, wherein the drainage insert has a rear face, and the at least one interior drainage passage is defined by at least a portion of the front and rear faces of the drainage insert, and by at least one of the side edges of the drainage insert.

3. The insulation board assembly of claim 1, wherein the drainage insert has at least one interior wall member positioned between the two side edges of the drainage insert and extending between the front face and the rear face of the drainage insert.

4. The insulation board assembly of claim 1, wherein the bottom edge of the drainage insert is flush with the bottom edge of the insulation board body.

5. The insulation board assembly of claim 1, wherein the drainage insert is positioned in the drainage channel such that a front face of the drainage insert is flush with the back face of the insulation board body.

6. The insulation board assembly of claim 5, wherein the drainage insert has a thickness between the front face and a rear face of the drainage insert that is approximately equal to the channel depth.

7. The insulation board assembly of claim 1, wherein the drainage insert has a width between the two side edges of the drainage insert that is approximately equal to a width of the drainage channel.

8. The insulation board assembly of claim 1, wherein the insulation board body has at least one additional drainage channel extending from the top edge to the bottom edge of the insulation board body.

9. The insulation board assembly of claim 1, wherein a thickness between the front and back faces of the insulation board body is between about 1.5" (38 mm) and about 6" (152 mm).

10. The insulation board assembly of claim 9, wherein the thickness between the front and back faces of the insulation board body is between about 2" (50 mm) and 5" (127 mm).

11. The insulation board assembly of claim 10, wherein the thickness between the front and back faces of the insulation board body is about 3" (76 mm).

12. The insulation board body of claim 1, wherein the channel depth is about ⅜" (10 mm).

13. The insulation board assembly of claim 1, wherein a width of the drainage channel is between about 1" (26 mm) and 4" (102 mm).

14. The insulation board assembly of claim 1, wherein the width of the drainage channel is about 2" (51 mm).

15. The insulation board assembly of claim 1, wherein the insulation board body has a density of about 4 to 12 lbs/ft$^3$ (64 to 192 kg/m$^3$).

16. The insulation board assembly of claim 15, wherein the insulation board body has a density of about 6 to 10 lbs/ft$^3$ (96 to 160 kg/m$^3$).

17. The insulation board assembly of claim 16, wherein the insulation board body has a density of about 8 lbs/ft$^3$ (128 kg/m$^3$).

18. The insulation board assembly of claim 1, wherein the insulation board body has an R-value at 1" and at 75° F. of about 4.0 hr.ft2/Btu, or an RSI value at 25.4 mm and at 24° C. of about 0.70 m2K/W.

19. The insulation board assembly of claim 1, wherein a juncture of the back face and the top edge of the insulation board body is beveled.

20. The insulation board assembly of claim 1, further comprising:

a reinforcing mesh secured to the insulation board body, the reinforcing mesh extending from the back face of the insulation board body, across the bottom edge, to the front face of the insulation board body, such that the reinforcing mesh positioned on the back face of the insulation board body overlaps at least a portion of the drainage insert.

21. The insulation board assembly of claim 20, wherein the reinforcing mesh positioned on the back face of the insulation board body overlaps the entire drainage insert.

22. The insulation board assembly of claim 20, further comprising a base coat applied to the reinforcing mesh at locations other than a lower end of the drainage channel.

23. The insulation board assembly of claim 22, wherein the base coat is a cementitious base coat.

24. The insulation board assembly of claim 1, wherein the at least one interior drainage passage is unperforated.

25. The insulation board assembly of claim 1, wherein the channel height is about four times greater than the insert height.

26. The insulation board assembly of claim 1, wherein the top edge of the insulation board body is beveled.

* * * * *